United States Patent [19]

Suzuki et al.

[11] 4,319,435

[45] Mar. 16, 1982

[54] BLASTING MACHINE FOR DEBURRING WORKPIECES

[75] Inventors: Shigenobu Suzuki; Kooichi Hayashi; Chiaki Hayashi; Toshiyuki Takagi, all of Shizuoka; Shigeharu Kobayashi, Yokohama, all of Japan

[73] Assignee: Fuji Seiki Machine Works, Ltd., Sunto, Japan

[21] Appl. No.: 146,542

[22] Filed: May 2, 1980

[30] Foreign Application Priority Data

May 17, 1979 [JP] Japan ..... 54-059725

[51] Int. Cl.[3] ..... B24C 3/12; B24C 3/22; B24C 7/00; B24C 9/00

[52] U.S. Cl. ..... 51/421; 51/425; 51/426; 51/436; 51/437; 417/346

[58] Field of Search ..... 51/421, 425, 426, 427, 51/436, 437, 320, 321; 417/342, 346, 539

[56] References Cited

U.S. PATENT DOCUMENTS

| | | | |
|---|---|---|---|
| 1,966,571 | 7/1934 | Webb | 51/426 X |
| 2,442,916 | 6/1948 | Buchanan | 417/346 |
| 2,549,851 | 4/1951 | Pope | 417/900 X |
| 2,660,955 | 12/1953 | Kent | 417/346 X |
| 2,819,835 | 1/1958 | Newhall | 417/346 |
| 3,192,677 | 7/1965 | Johnson | 51/321 |
| 3,298,322 | 1/1967 | Sherrod | 417/900 X |
| 3,455,062 | 7/1969 | Eppler | 51/425 |
| 3,553,895 | 1/1971 | Power | 51/436 |

*Primary Examiner*—Gary L. Smith

*Attorney, Agent, or Firm*—Blanchard, Flynn, Thiel, Boutell & Tanis

[57] ABSTRACT

A wet blasting machine for permitting deburring of workpieces by utilizing a slurry of water and abrasive particles. The slurry is discharged by a blasting gun against the workpiece, and is then collected within a reclaiming tank. The top water flows from the reclaiming tank into an intermediate settling tank, and the top water is then withdrawn therefrom into a clear water tank. A multiple-section reciprocating pumping unit supplies pressurized water from the clear water tank to the blasting gun, which sucks slurry to the gun from an abrasive particle reservoir located approximately at or above the elevation of the gun. The abrasive particles are supplied to the reservoir from the reclaiming tank.

9 Claims, 9 Drawing Figures

BLASTING MACHINE FOR DEBURRING WORKPIECES

FIELD OF THE INVENTION

This invention relates to improvements in a wet abrasive-particle blasting machine for effecting deburring of a workpiece.

BACKGROUND OF THE INVENTION

There are many kinds of burrs, e.g., burrs at the end of a surface cut by a cutting tool, burrs at the edge of a stamped plate, burrs at the seam of the mold in die casting, beads caused by flame cutting or welding, etc. Hitherto, these burrs were often removed manually. However, in the progress of production techniques, and to increase productivity, the methods of burr removal developed in many ways, including mechanical, chemical or electro-chemical ways.

The primary requisite conditions in deburring are (1) the primary purpose of the initial production process, in which burrs are formed, can not be effected by the deburring operation, (2) the deburring may not alter the physical nature of the material, (3) the deburring may not obstruct the following processes and (4) the deburring process can not damage the surface of the workpiece. These conditions are severe. A water jet blasting machine is offered for removing burrs so as to satisfy these prerequisite conditions. However, in the known blasting machines, the pressure of water used is often as high as 250 kg/sq cm (or 3,500 psi.). The blasting machine thus needs a large capacity pump, which is extremely expensive.

This invention relates to a machine for permitting deburring in a manner so as to satisfy the above requisite conditions, while at the same time providing a machine which is substantially less expensive and permits use of substantially lower water pressures than is conventionally utilized by the above-described wet blasting machines which rely solely on a water jet for effecting burr removal.

More specifically, this invention relates to a blasting machine which uses an abrasive particle-water slurry for blasting so as to effect burr removal, whereby the machine thus permits utilization of a substantially reduced water pressure level, the pressure of the water being reduced to approximately 30 kg/sq cm (450 psi.). The capacity of the pump thus need not be so large. Water blasted from the gun, with abrasive particles mixed therein, is separated from solid particles and reused repeatedly. Water is used in supporting and expelling the abrasive particles. On the other hand, small solid particles existing in the slurry, such as fractures of the abrasive particles or small metal fragments removed by blasting, are removed as much as possible. The water blasts from the gun at substantially constant pressure without pulsation. The consumed abrasive particles are suitably replenished. These conditions are objects achieved by the improved blasting machine of this invention.

DETAILED DESCRIPTION

Figure 1:
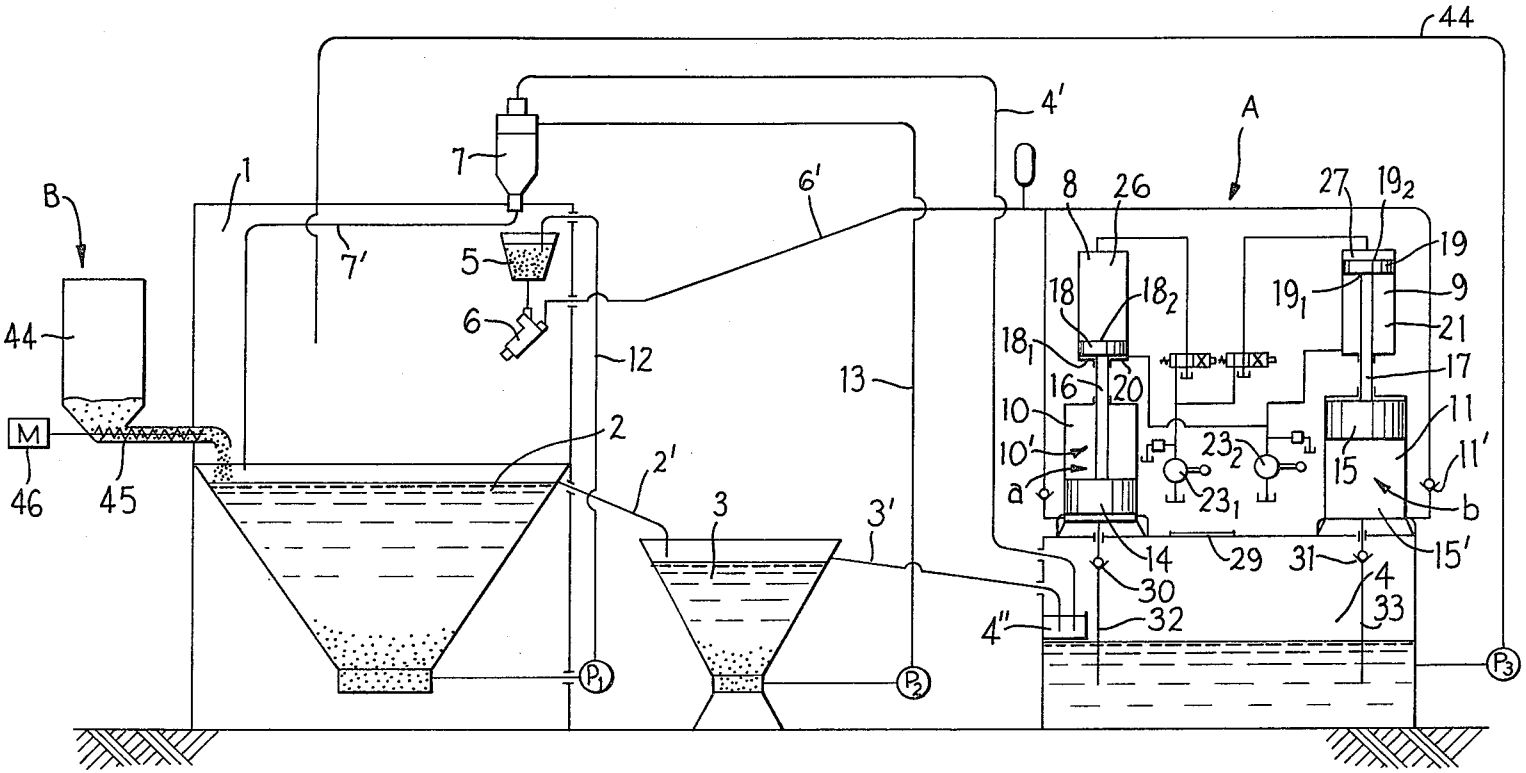
FIG. 1 diagrammatically illustrates the blasting machine of this invention.

Referring to FIGS. 1–4, there is illustrated a first variation of the improved blasting machine of the present invention, which machine is illustrated as employing a single blasting gun.

The machine includes a suitable housing which defines therein a substantially closed blasting chamber 1. A slurry reclaiming tank or hopper 2 is positioned directly below the blasting chamber for collecting therein the water-abrasive particle slurry. Since the abrasive particles have a tendency to settle within the hopper 2, the partially clarified water overflows or is withdrawn adjacent the top of the hopper through the pipe 2' and is induced into the settling tank 3. The clarified water from settling tank 3 overflows or is withdrawn therefrom and is induced to flow through the pipe 3' for collection within the clear water tank 4, the latter being provided with a filtering device 4'', if necessary, through which the water from pipe 3' is discharged.

The blasting chamber 1 has an abrasive particle reservoir 5 associated therewith, which reservoir 5 is preferably mounted at the same elevation as, or slightly above, the elevation of the blasting gun 6. This reservoir 5 contains a slurry having a high concentration of abrasive particles therein. The reservoir 5 has a supply or inducing pipe connected between the lower part thereof and the blasting gun for supplying the slurry, and specifically the abrasive particles, to the gun. The reservoir 5 is supplied with slurry from the bottom of the reclaiming tank 2 through piping 12 having a slurry pump $P_1$ associated therewith.

The abrasive particle reservoir 5, and its relationship to the blasting gun 6, is preferably constructed in accordance with the invention disclosed in copending application Ser. No. 146,541, entitled "Two-Tank High Water Pressure System With Separate Abrasive Particle Reservoir", which latter application is owned by the same assignee as this application and was filed concurrently herewith. The complete disclosure of this latter-mentioned copending application is incorporated herein, in its entirety, by reference.

The abrasive particles and other solid particles which settle in the bottom of the settling tank 3, together with water, are sent by the slurry pump $P_2$ to the liquid-solid separation device 7, for instance a hydro cyclone. Here the separated solids are returned to the reclaiming hopper 2 through piping 7', and the separated liquid is sent to the clear water tank 4 through piping 4' and via filter 4''.

The clear water in the tank 4 is sent to the blasting gun 6 through the piping 6' by the reciprocating pumping device A. This pumping device A comprises two water-pressurizing pistons 14 and 15 mating respectively with cylinders 10 and 11 driven by oil hydraulic cylinders 8 and 9. The pistons 14 and 15, and their cylinders 10 and 11, form the reciprocating pump sections a and b. The reciprocating pumping device A shall be described in more detail hereinafter.

Figure 2:
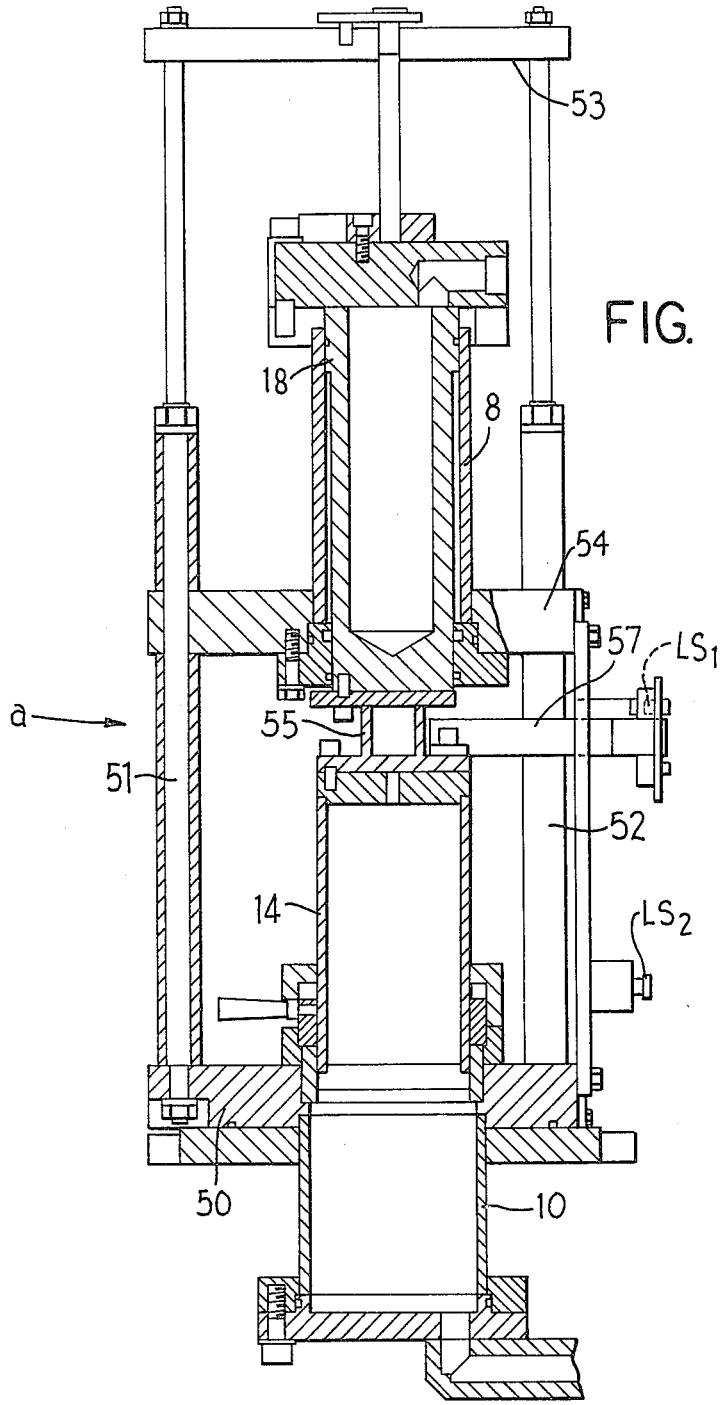
FIG. 2 is a partial cross-sectional view illustrating the cylinder unit associated with the main pump, and its associated limit switches.
Figure 3:
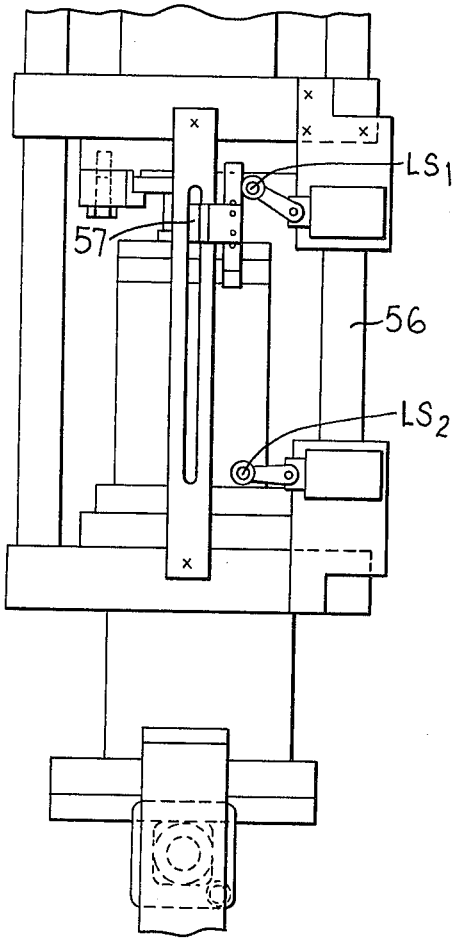
FIG. 3 is a partial side view of FIG. 2.
Figure 4:
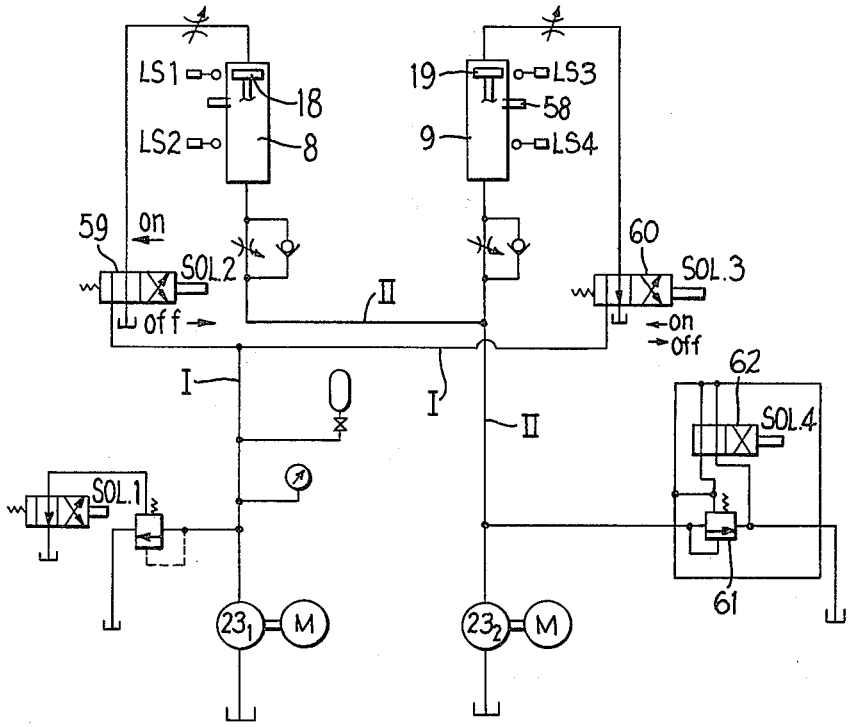
FIG. 4 diagrammatically illustrates the hydraulic circuitry for the machine of FIGS. 1–3.

FIGS. 2 and 3 illustrate the relationship between hydraulic cylinder 8, piston 18, cylinder 10 for sending pressurized water, and its piston 14. These parts are shown schematically in FIG. 1 by line drawing. The following describes the structure of the reciprocating pump device by using pumping section a as an example.

Cylinder 10 for pressurized water is fixedly mounted relative to a bottom frame plate 50. A pair of rods 51 and 52 project from plate 50. Oil hydraulic cylinder 8 is fixed on and between the cross plates 53 and 54 which are fixed on the rods 51 and 52. The piston 18 can move up and down in cylinder 8, and the piston 14 can move up and down in cylinder 10. The two aligned pistons 10 and 18 are fixedly connected together by a coupling 55. A board 56 extends between plates 50 and 54, and limit switches $LS_1$ and $LS_2$ are attached on this switch board 56. An actuating arm 57 is fixed to and protrudes sidewardly from the root of the coupling 55. If the piston 18 is in position at the top of the stroke in cylinder 8, the actuating arm 57 works on limit switch $LS_1$ to control the downward movement of the piston 18. $LS_1$ also provides a different operating function at the time when contact between arm 57 and limit switch $LS_1$ is lost by downward movement of the piston 18, as explained hereinafter.

As the piston 18 descends, the actuating arm 57 operates on limit switch $LS_2$ when piston 18 approaches the lower end of its stroke.

The oil hydraulic cylinder 9 shown in FIG. 1 has the same structure and function as that of cylinder 8. A description on the piston 19 and two limit switches $LS_3$ and $LS_4$, which are actuated by the arm 58 projecting from the coupling of the piston 19, is thus not repeated.

When limit switch $LS_1$ is in contact with actuating arm 57, and $LS_3$ or $LS_4$ is in contact with actuating arm 58, the solenoid coil SOL2 of the directional magnet valve 59 is energized, or "on", so that valve 59 opens the oil circuit I. The oil circuit I, which has valves 59 and 60 associated therewith, selectively supplies pressurized oil to the upper part of the cylinders 8 and 9. The piston 18 descends when valve 59 opens. Contact between limit switch $LS_1$ and arm 57 is lost when the piston 18 has descended a short distance from its upper limit. This loss of contact between $LS_1$ and arm 57, coupled with contact between $LS_4$ and arm 58, causes the solenoid coil SOL3 of directional valve 60 to be deenergized, or "off". This means that piston 19 can ascend since the oil pressure in the upper end of the cylinder 9 opens to the oil tank or reservoir. When the piston 19 reaches the upper part of the cylinder 9, limit switch $LS_3$ is contacted by actuating arm 58 of piston 19, which limit switch acts on the solenoid coil SOL3. During the continued descending motion of the piston 18, limit switch $LS_2$ is contacted by the lever 57 and it also acts on the solenoid coil SOL3 of the directional valve 60, thus making it act, or be "on". Thus, pressurized oil is supplied to the upper end of cylinder 9 and its piston 19 only after the two limit switches $LS_2$ and $LS_3$ are "on" or actuated. Contact between $LS_3$ and actuating arm 58 of piston 19 is lost after the piston 19 has descended at least a short distance. This loss of contact between $LS_3$ and arm 58, coupled with contact between $LS_2$ and arm 57, activates the solenoid coil SOL2 of the directional valve 59 to "off" so that piston 18 can ascend. Actuation of limit switch $LS_4$ by piston 19 when it reaches the lower end of its stroke, coupled with actuation of $LS_1$ when piston 18 reaches the upper end of its stroke, turns the coil SOL2 "on" so that oil is supplied to the upper end of cylinder 8 whereby piston 18 again descends.

The use of the two reciprocating pumping sections a and b, and the control over the reciprocating movement thereof, provides a substantially steady and uniform supply of pressurized water to the blasting gun. The downward movement of the pistons 18 and 19, which results in pressurization of the water within the cylinders 10 and 11, occurs in an out-of-phase relationship. That is, the initial descent of the piston 18 away from its uppermost position, occurs or overlaps with the terminal descent of the piston 19 as the latter approaches its lowermost position. The piston 19 is then reversed and moved rapidly upwardly while the piston 18 continues its descent. The piston 19 then reverses and begins its initial descent in overlapping relationship with the terminal descent of the piston 18 as the latter approaches its lowermost position, whereupon it is reversed and rapidly moved upwardly during the continued descent of the piston 19. The descending motion of the pistons 18 and 19 thus occurs out-of-phase but with overlapping so as to result in a continuous supply of pressurized water through the piping 6' to the gun 6.

The operation of the blasting machine illustrated in FIGS. 1–4, and specifically the control and operation of the reciprocating pumping device A, as briefly outlined in Table I, will now be described in greater detail.

When the machine is to be activated, the operator energizes the machine by turning it on, such as by pushing an "operation" button. This energizes the pumps $23_1$ and $23_2$ as associated with the hydraulic circuits I and II, respectively. The valves 59 and 60 are both initially closed. Assuming that the pistons 18 and 19 are not at their uppermost position, they are pushed into their upper positions by the pressurized oil supplied to circuit II by the pump $23_2$. This circuit II continuously urges the pistons 18 and 19 upwardly. The pistons 18 and 19, when in their uppermost positions, cause activation of limit switches $LS_1$ and $LS_3$ due to their engagement by the actuating arms 57 and 58. This results in energization of solenoid SOL2 so that valve 59 is opened, whereby pressure fluid from circuit I is supplied to the upper end of cylinder 8 so that piston 18 begins to descend. This activation of valve 59 is caused by engagement of arm 58 with either $LS_3$ or $LS_4$, together with engagement of limit switch $LS_1$ by arm 57. During this downward movement of piston 18, the water-pressurizing piston 14 of pump section a pressurizes the water in the lower chamber of cylinder 10 and forces same through piping 6' to the blasting gun 6.

When the piston 18 approaches its lowermost position so that the arm 57 thereon engages the limit switch $LS_2$, and inasmuch as the arm 58 of piston 19 has already engaged limit switch $LS_3$, the valve 60 is opened so that circuit I now also supplies pressure fluid to the upper end of cylinder 9. The piston 19 associated with pump section b thus begins to descend, which initial descent of piston 19 overlaps with the terminal descent of piston 18. In this stage, the supply of pressurized water through piping 6′ to the blasting gun is accomplished by both pistons 14 and 15 at the same time since they are both descending (i.e., the pressurizing and exhausting stroke). Under this condition, any increase in oil pressure within circuit I is adjusted by the relief valve 61.

During this terminal descent of piston 18, the downward descent of piston 19 results in its actuating arm 58 leaving contact with limit switch $LS_3$, which disengagement occurs after the piston 19 has descended at least a selected distance. This disengagement between $LS_3$ and actuating arm 58, coupled with the engagement between actuating arm 57 and limit switch $LS_2$, thus deenergizes or turns "off" the valve 59, thereby opening the circuit to the upper part of cylinder 8 to the oil reservoir. Piston 18 associated with pump section a is then rapidly moved upwardly back to its upper stroke end due to the pressurized fluid supplies to the lower side of piston 18 by the circuit II. This upward ascent or return of piston 18, which is the suction stroke since water from tank 4 is sucked into the lower end of cylinder 10, occurs more rapidly than the descent of the piston inasmuch as the latter is controlled by the pressure in circuit I, which circuit is typically provided with a suitable throttling device for controlling the flow of pressure fluid into the upper end of the cylinder 8. Also, the pressure in circuit I must act against the continuous pressure of circuit II in order to move the piston downwardly. The piston 18 again actuates limit switch $LS_1$ when it reaches its upper stroke end.

During the ascent of piston 18, the piston 19 continues its descent and, as it nears its lower stroke end, its actuating lever 58 contacts and actuates limit switch $LS_4$. Actuation of limit switch $LS_4$, coupled with actuation of limit switch $LS_1$ when piston 18 reaches its upper stroke end, results in valve 59 being opened or turned "on". Pressure fluid from circuit II is again supplied to the upper end of cylinder 8 so that piston 18 of pump section a again begins to descend. After having descended a small distance from its upper stroke end, lever 57 disengages limit switch $LS_1$ which, coupled with engagement of $LS_4$ by arm 58, causes solenoid SOL3 of valve 60 to be turned "off" so that the valve 60 is moved so as to dump the pressure fluid (oil) from within the upper chamber of cylinder 9 into the oil reservoir. Accordingly, the pressure fluid from circuit II acting against the bottom of piston 19 (pump section b) causes the piston to rapidly ascend back to its upper stroke end, while the piston 18 continues its descent. When piston 19 reaches its upper stroke end, it again actuates limit switch $LS_3$ which, coupled with actuation of limit switch $LS_2$ by the piston 18 when the latter approaches its lower stroke end, thus turns solenoid SOL3 "on" so that valve 60 is opened to again pressurize the upper end of cylinder 9 whereby the piston 19 again begins to descend.

The above operational cycles are repeatedly performed. There occurs no pulsation in the supply of the pressurized water at the time when the one piston changes its stroke direction from suction to exhaustion, or ascending to descending, because when one piston changes its stroke direction, the other piston is still supplying pressurized water. Consequently, the deburring function is carried out effectively and continuously.

Pistons 18 and 19, which receive pressure on both the upper and lower sides, as supplied by the different pumps, thus can move at a slow speed. Wear of all pistons is kept to a minimum, particularly since the water sucked from clear water tank 4 has passed through the settling tank 3 and the filter 4″. The water in settling tank 3 is induced from the reclaiming hopper 2. Low speed movement of the pistons, and the use of self-cleared water by settling, make wear of the pistons a minimum. For example, a commercial pump using a piston coated by hard chrome plating on its surface, wears out after about 95 hours of use. (Stroke length of piston is 50 millimeters, number of strokes per minute is 600). After the surface of the piston is covered by a hard wear-resistant layer, such as sintered carbon of thickness 0.02 millimeters, the life of the pump piston is about 900 hours. By using the same piston having the same hard facing layer, the pump has a life of about 12,000 hours (or one and one-half year life) by lowering the stroke to 5 meters per minute (50 cycles per minute). A water pressure of 30 kg/sq cm is easily achieved by use of reciprocating pump of this invention. Accordingly, an excellent deburring operation is performed by use of this machine.

The above objectives, namely providing the desired water pressure while using slow piston speeds, is facilitated by the fact that the pumping device A functions as a pressure transducer, this being accomplished by making the area of pistons 18–19 substantially smaller than the area of pistons 14–15.

Referring now to FIGS. 5–9, there is illustrated a variation of the blasting machine according to the present invention, in which variation the blasting chamber of the machine is provided with a plurality of blasting stations (there normally being one gun at each station), and the reciprocating pumping device is provided with a number of pairs of pumping sections corresponding to the number of blasting stations.

Figure 5:
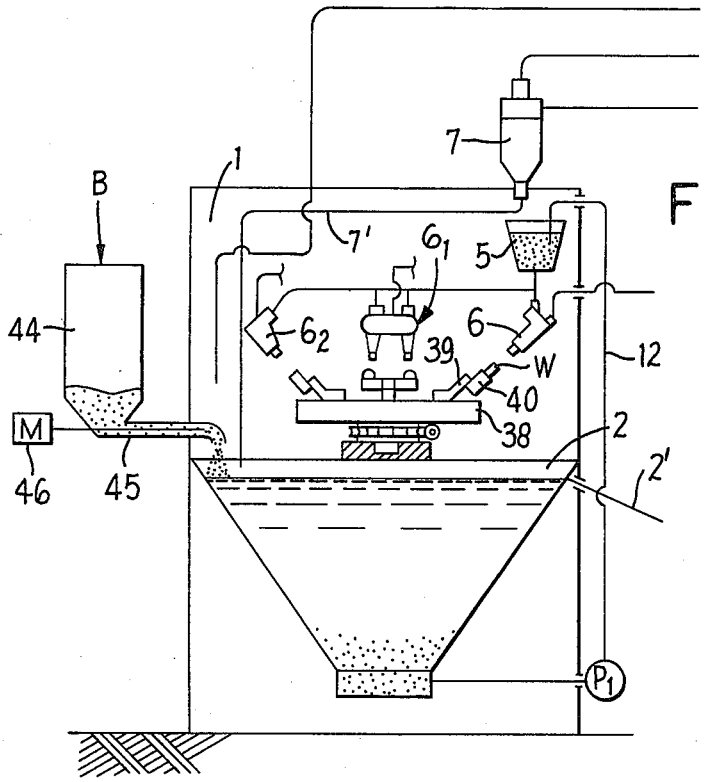
FIG. 5 diagrammatically illustrates the blasting chamber in accordance with a modified version of the improved blasting machine.
Figure 6:
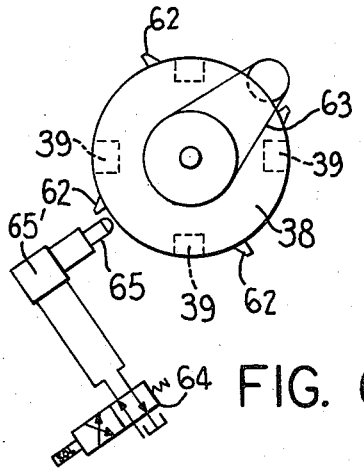
FIG. 6 illustrates, in plan view, the indexing mechanism for the turntable associated with the machine of FIG. 5.
Figure 7:
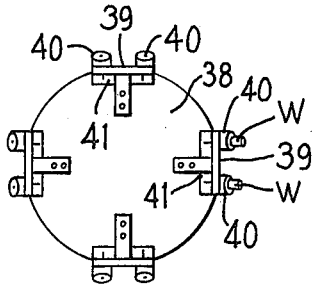
FIG. 7 is a plan view of the turntable associated with the machine of FIG. 5.

As illustrated by FIGS. 5–7, the blasting chamber has positioned therein a horizontally rotatable turntable 38 which can be driven in a suitable manner, such as by a belt 63. Turntable 38 has a plurality of projections 62 provided around the periphery thereof, the number of such projections corresponding with the number of blasting or working stations. A stopping bar or element 65 is disposed adjacent the side of the turntable and positioned for engagement with the projections 62 as shown by FIG. 6. This stopping bar 65 extends or retracts, this movement being controlled by the air cylinder 65′, the movement of which is regulated by controlling the flow of air to the cylinder 65′ by an electromagnetic shiftable flow valve 64. When the turntable 38 is rotated, it advances until one of the projections 62 engages the stop bar 65, thereby holding the turntable stationary, at which time the drive belt 63 slips on the pulley associated with the underside of the turntable. In this stopped position, the blasting guns act on the workpieces mounted on the turntable. By momentarily retracting the stop 65, the turntable 38 is then permitted to rotate through the next angular increment.

Figure 8:
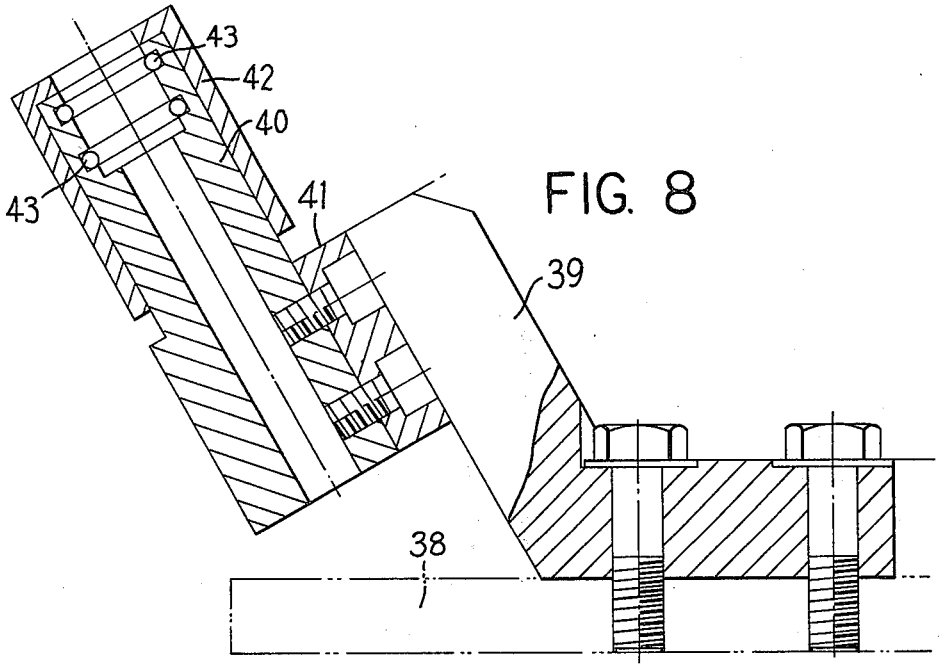
FIG. 8 is an enlarged, fragmentary, partial sectional view of the work-holding device associated with the turntable illustrated in FIGS. 5 and 7.

The turntable is provided with a plurality of work holders 39 thereon at angularly spaced intervals, these work holders 39 being mounted on radial lines of the turntable. The work holder 39, as illustrated in FIG. 8, is bolted to the turntable and, in turn, supports thereon a side bar 41, which in turn mounts a support 40 for a workpiece. This support 40 is of cylindrical shape and has an opening or bore extending axially therethrough. The longitudinal axis of centerline of the support 40 can be substantially aligned with the direction of the stream as discharged from the respective blasting gun.

The support 40 has ring springs 43 associated within the cylindrical bore thereof so as to permit resilient holding of the workpiece thereon, a portion of the workpiece being inserted into the bore of the support and resiliently gripped by the springs 43. A protective cuplike cap 42 covers the surface of the support to protect it from abrasion by the blasted slurry.

In the example illustrated by FIGS. 5–9, the machine is illustrated as being provided with four workpiece stations positioned angularly about the turntable, each station being defined by one of the work holders 39. However, each work holder 39 may have one or more workpiece supports 40 positioned in side-by-side relationship thereon, there being two in the illustrated embodiment so as to permit simultaneous holding of two workpieces. A blasting gun is mounted for association with each workpiece station, there being two blasting guns positioned side-by-side (but functioning as a single gun) at each station in the illustrated embodiment so as to permit each blasting gun to individually operate on each workpiece. In this case, one reciprocating section of the pumping device, such as one pair of cylinders 18 and 19, is sufficient to deliver a sufficient amount of pressurized water to the blasting gun or guns at each station. The blasting guns themselves are arranged in a circular angularly-spaced array above the turntable 38 so that they are positioned in correspondence with the holders 39 on the turntable 38. In the illustrated embodiment, the turntable 38 turns intermittently through 90° intervals. After each 90° rotation, the workpieces mounted on the turntable are exposed to a jet stream of slurry at a different location. Thus, three different locations of the workpiece can be blasted, one at each of the three different 90° positions (i.e., stations) of the turntable. The fourth 90° position or station can be used for loading and unloading workpieces.

Figure 9:
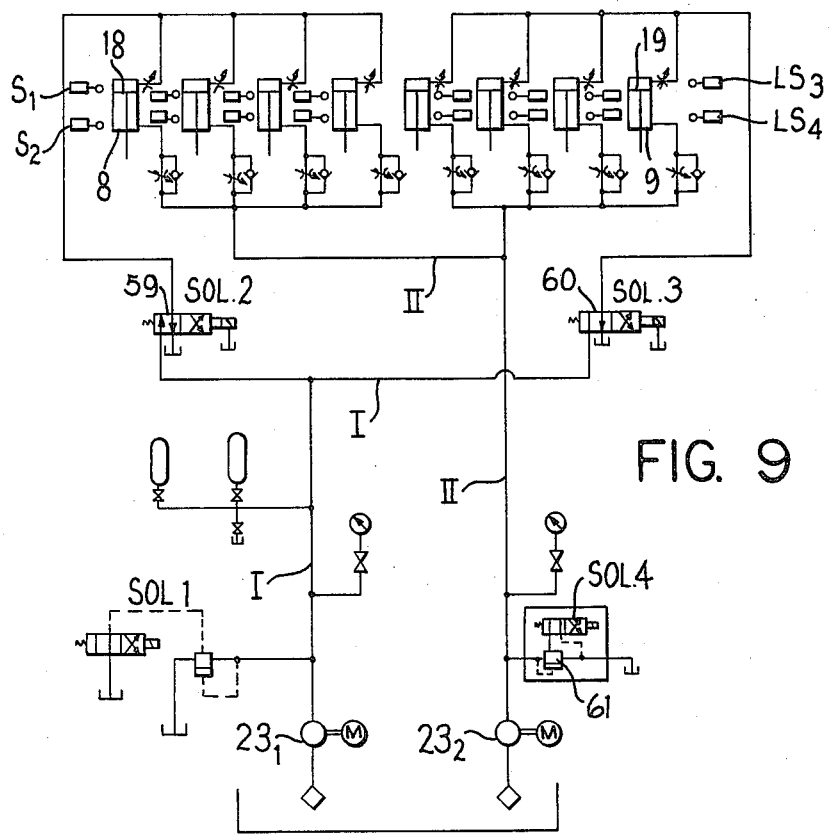
FIG. 9 diagrammatically illustrates a hydraulic circuit for the modified machine of FIGS. 5–8, which circuit controls a plurality of blasting guns.

FIG. 9 illustrates the hydraulic control circuit for the machine of FIGS. 5–8. This control circuit of FIG. 9 substantially corresponds to that of FIG. 4 except that the numbers of pairs of cylinders 18–19 have necessarily been increased consistent with the number of blasting guns or blasting stations provided by the machine. The circuit, in all other respects, however, operates in the same manner as described above relative to FIG. 4.

During operation of the machine of FIG. 5, burrs at several locations on the workpiece can be sequentially removed. For example, after the turntable 38 rotates 90° and stops at a first station, burrs in one location of the workpiece can be removed by blasting the workpiece at the first station. Then, stopping bar 65 is momentarily retracted to disengage it from the projection 62, whereupon turntable 38 rotates 90° until the next projection 62 engages the stop bar. The workpiece has thus been moved to the second working station, whereupon it is exposed to the blasted slurry stream at this second station so as to permit removal of burrs from another part or location of the workpiece. This sequence can be repeatedly performed so that a number of burrs at different parts or areas of the workpiece can thus be succeedingly removed.

As illustrated by both FIGS. 1 and 5, the machine of this invention can be provided with a device B for replenishing abrasive particles. This device includes a hopper 44 for storing therein abrasive particles, which hopper is positioned adjacent the blasting chamber and has a bottom discharge tube which communicates with the reclaiming tank 2. A rotatable screw conveyor 45, driven by a motor 46, is associated with the discharge tube of the hopper 44 for permitting desired quantities of abrasive particles to be supplied into the tank 2 when replenishment of abrasive particles is required.

Thus, with the machine of this invention, abrasive particles blasted together with pressurized water of 30 kg/sq cm remove burrs without damaging previous machining operations, without altering the physical properties of the material, and without damaging other surfaces on the workpiece. Further, pressurized water is reused from the reclaimed slurry in the hopper of the blasting chamber after passing through a settling tank and a filter. A reciprocating pump, for supplying pressurized water, has pistons moving at low speed. Thus, the pistons do not wear even if the filtered water contains minute fractures of the abrasive particles or small burrs which can not be removed by the filtering devices. Pressurized water is sent to the blasting gun without pulsation. The pressure of the water and stroke speed of the piston can be regulated by the pressure control of the hydraulic oil unit and the flow control valve in the oil circuit. An intermittently moving turntable can be installed in the blasting chamber, and the workpieces can be easily mounted on and removed from the fixtures on the turntable. When burrs have formed at several locations of the workpiece, they can be removed succeedingly at different blasting stations, wherein a blasting gun at each station removes burrs in the different locations of the workpiece. The deburring operation can be performed effectively without help of manual labor. The new abrasive particles are replenished to the hopper at necessary time intervals, which is regulated by the timing relay. The pump used in this machine is of reciprocating type and its regular pressure is approximately 30 kg/cm$^2$. The cost of the pump is thus rather low when compared with high pressure pumps supplying pressures of 250 kg/sq cm. This blasting machine has proven to work very effectively for deburring when the water pressure is approximately 30 kg/cm$^2$, and when using abrasive particles of aluminum oxide of mesh size between No. 20 and No. 60. However, when heavier particles such as steel grit are used, an even lower water pressure such as less than 20 kg/cm$^2$ can be used.

Although a particular preferred embodiment of the invention has been disclosed in detail for illustrative purposes, it will be recognized that variations or modifications of the disclosed apparatus, including the rearrangement of parts, lie within the scope of the present invention.

TABLE I.

| | Movement of Pistons and State of Limit Switch And Solenoid Coil | | | | | | | |
|---|---|---|---|---|---|---|---|---|
| | $LS_1$ | $LS_2$ | $LS_3$ | $LS_4$ | $SOL_1$ | $SOL_2$ | $SOL_3$ | $SOL_4$ |
| Starting Position | on | off | on | off | off | off | off | on |
| Pump section a starting to descend | on | off | off | on | on | on | on | on |

TABLE I.-continued

| | Movement of Pistons and State of Limit Switch And Solenoid Coil | | | | | | | |
|---|---|---|---|---|---|---|---|---|
| | $LS_1$ | $LS_2$ | $LS_3$ | $LS_4$ | $SOL_1$ | $SOL_2$ | $SOL_3$ | $SOL_4$ |
| Pump section b starting to descend | off | on | on | off | on | on | on | on |
| Pump section a starting to ascend | off | on | off | off | on | off | on | on |
| Pump section b starting to ascend | off | off | off | on | on | on | off | on |

The embodiments of the invention in which an exclusive property or privilege is claimed are defined as follows:

1. In a wet blasting machine for deburring, said machine having means defining therein a blasting chamber, blasting gun means positioned within said chamber for discharging a slurry of water and abrasive particles against a workpiece, a reclaiming tank located below the blasting chamber for collecting therein the slurry, a clear water tank containing therein a quantity of clear water, pump means for supplying clear water to said blasting gun means to create a water jet stream which functions as the driving force for ejecting a slurry of water and abrasive particles from said gun means, and means for supplying the slurry containing said abrasive particles to said gun means, the improvement comprising:

settling tank means for receiving therein water from the upper portion of said reclaiming tank, said settling tank means permitting further solid particles to be settled therein, and means for supplying water from the upper portion of said settling tank means to said clear water tank;

said supplying means including reservoir means containing therein said slurry having a concentration of abrasive particles associated therewith, said reservoir means being disposed above said reclaiming tank and positioned at an elevation approximately equal to or above the elevation of said blasting gun means;

said supplying means also including conduit means extending from the bottom portion of said reservoir means to said gun means for supplying abrasive particles thereto, and slurry pumping means for supplying the slurry as accumulated within said reclaiming tank to said reservoir means;

said pump means comprising a reciprocating pumping device having at least two reciprocating pumping sections which are driven in an out-of-phase relationship to continuously supply an uninterrupted stream of pressurized water to said blasting gun means;

each said reciprocating pumping section including a double-acting oil cylinder means having a reciprocal oil-actuated piston, and a water-pressurizing cylinder means having a reciprocal water-pressurizing piston, said water-pressurizing piston being connected to and driven by said oil-actuated piston;

said water-pressurizing cylinder means including first conduit means associated therewith and communicating with said clear water tank for sucking water from said tank during the suction stroke of the water-pressurizing piston, and second conduit means connected to said blasting gun means for supplying pressurized water thereto during the exhaust stroke of said water-pressurizing piston;

said reciprocating pumping device including first oil circuitry means connected to the oil cylinder means of both pumping sections, and having a first pressure pump associated therewith, for supplying pressurized oil to one side of the oil cylinder means to thereby move the oil-actuated pistons in one direction so as to cause the corresponding water-pressurizing piston to be driven through its exhaust stroke;

said reciprocating pumping device including second oil circuitry means connected to the oil cylinder means of both pumping sections, and including second pressure pump associated therewith, for supplying pressurized oil to the other side of the oil cylinder means to individually move the oil-actuated pistons in the opposite direction so that they thereby drive the respective water-pressurizing piston through its suction stroke;

said reciprocating pumping device having means associated thereafter for causing each oil-actuated piston and its respective water-pressurizing piston to be driven at a slow speed during the exhaust stroke, and at a faster speed during the suction stroke, so that the exhaust stroke requires a greater time than does the suction stroke; and control means associated with said reciprocating pumping device for controlling the reciprocating movement of said two reciprocating pumping sections so that the two reciprocating pumping sections are moved in an out-of-phase relationship such that at least one of the reciprocating pumping sections is supplying pressurized water to said gun means at all times, said control means causing the initial piston displacement of one reciprocating pumping section during its exhaust stroke to overlap with the terminal piston displacement of the other reciprocating pumping section when the latter is completing its exhaust stroke, whereby the suction stroke of the other reciprocating pumping section occurs wholly during a central portion of the exhaust stroke of said one reciprocating pumping section, and vice versa.

2. A machine according to claim 1, including a solid-liquid separator, first means for supplying slurry concentrated with abrasive particles from the bottom of said settling tank means to said separator, second means for supplying the separated liquid from said separator to said clear water tank, and third means for supplying the separated abrasive particles from said separator to either said reclaiming tank or said reservoir means.

3. A blasting machine according to claim 1, wherein said first circuitry means includes a separate first conduit connected to each of the oil cylinder means for supplying pressurized oil thereto during the exhaust stroke, each of said first conduits having controllable valve means associated therewith for permitting the pressurized oil in the respective first conduit to be returned to an oil collecting reservoir during the suction stroke, and said second circuitry means including a second conduit connected to each of the oil cylinder means for supplying pressurized oil against the other face of the respective oil-actuated piston, said second circuitry means maintaining a continuous pressure against the other face of said oil-actuated piston so as to restrict the movement thereof during the exhaust stroke while permitting faster movement thereof during the suction stroke due to the exhausting of the oil from said one side of the oil-actuated piston through the respective first conduit.

4. A machine according to claim 1, including an abrasive particle-supplying device positioned outside of the blasting chamber for replenishing the quantity of abrasive particles within the reclaiming tank.

5. A machine according to claim 1, including turntable means rotatably supported within said blasting chamber, said turntable means having a plurality of work holders mounted thereon at angularly spaced intervals therearound for permitting a plurality of workpieces to be simultaneously mounted on said turntable means, said blasting gun means including a plurality of blasting guns mounted within said blasting chamber at angularly spaced intervals within an arcuate array, said plurality of guns being disposed above said turntable means and being angularly spaced apart so as to correspond with the positioning of the work holders on the turntable means, whereby a plurality of workpieces can be simultaneously acted on within the blasting chamber.

6. A machine according to claim 5, including driving and controlling means cooperating with said turntable means for permitting intermittent rotation thereof in a steplike manner through angular intervals corresponding to the angular spacing between blasting guns so that each workpiece is intermittently moved from a position beneath one blasting gun into a position beneath the next adjacent blasting gun for permitting successive blasting operations to be carried out on each workpiece.

7. A machine according to claim 5 or claim 6, wherein said reciprocating pumping device includes a plurality of pairs of reciprocating pumping sections, each pair being connected to the blasting gun or guns at a single station for supplying pressurized water thereto.

8. In a wet blasting machine for deburring, said machine having means defining therein a blasting chamber, blasting gun means positioned within said chamber for discharging a slurry of water and abrasive particles against a workpiece, a reclaiming tank located below the blasting chamber for collecting therein the slurry, a clear water tank containing therein a quantity of clear water, pump means for supplying clear water to said blasting gun means to create a water jet stream which functions as the driving force for ejecting a slurry of water and abrasive particles from said gun means, and means for supplying the slurry containing said abrasive particles to said gun means, the improvement comprising:

said pump means including a reciprocating pumping device having at least two reciprocating pumping sections which are driven in an out-of-phase relationship to continuously supply an uninterrupted stream of pressurized water to said blasting gun means;

each said reciprocating pumping section including a double-acting oil cylinder means having a reciprocal oil-actuated piston, and a water-pressurizing cylinder means having a reciprocal water-pressurizing piston, said water-pressurizing piston being connected to and driven by said oil-actuated piston;

said water-pressurizing cylinder means including first conduit means associated therewith and communicating with said clear water tank for sucking water from said tank during the suction stroke of the water-pressurizing piston, and second conduit means connected to said blasting gun means for supplying pressurized water thereto during the exhaust stroke of said water-pressurizing piston;

said reciprocating pumping device including first oil circuitry means connected to the oil cylinder means of both pumping sections, and having a first pressure pump associated therewith, for supplying pressurized oil to one side of the oil cylinder means to thereby move the oil-actuated pistons in one direction so as to cause the corresponding water-pressurizing piston to be driven through its exhaust stroke;

said reciprocating pumping device including second oil circuitry means connected to the oil cylinder means of both pumping sections, and including a second pressure pump associated therewith, for supplying pressurized oil to the other side of the oil cylinder means to individually move the oil-actuated pistons in the opposite direction so that they thereby drive the respective water-pressurizing piston through its suction stroke;

said reciprocating pumping device having means associated therewith for causing each oil-actuated piston and its respective water-pressurizing piston to be driven at a slow speed during the exhaust stroke, and at a faster speed during the suction stroke, so that the exhaust stroke requires a greater time than does the suction stroke; and control means associated with said reciprocating pumping device for controlling the reciprocating movement of said two reciprocating pumping sections so that the two reciprocating pumping sections are moved in an out-of-phase relationship such that at least one of the reciprocating pumping sections is supplying pressurized water to said gun means at all times, said control means causing the initial piston displacement of one reciprocating pumping section during its exhaust stroke to overlap with the terminal piston displacement of the other reciprocating pumping section when the latter is completing its exhaust stroke, whereby the suction stroke of the other reciprocating pumping section occurs wholly during a central portion of the exhaust stroke of said one reciprocating pumping section, and vice versa.

9. A blasting machine according to claim 8, wherein said first circuitry means includes a separate first conduit connected to each of the oil cylinder means for supplying pressurized oil thereto during the exhaust stroke, each of said first conduits having controllable valve means associated therewith for permitting the pressurized oil in the respective first conduit to be returned to an oil collecting reservoir during the suction stroke, and said second circuitry means including a second conduit connected to each of the oil cylinder means for supplying pressurized oil against the other face of the respective oil-actuated piston, said second circuitry means maintaining a continuous pressure against the other face of said oil-actuated piston so as to restrict the movement thereof during the exhaust stroke while permitting faster movement thereof during the suction stroke due to the exhausting of the oil from said one side of the oil-actuated piston through the respective first conduit.

* * * * *

UNITED STATES PATENT AND TRADEMARK OFFICE

CERTIFICATE OF CORRECTION

PATENT NO. : 4 319 435

DATED : March 16, 1982

INVENTOR(S) : Shigenobu Suzuki et al

It is certified that error appears in the above—identified patent and that said Letters Patent is hereby corrected as shown below:

Column 10, line 36; change "thereafter" to ---therewith---.

Signed and Sealed this

Twentieth Day of July 1982

[SEAL]

*Attest:*

GERALD J. MOSSINGHOFF

*Attesting Officer*

*Commissioner of Patents and Trademarks*